US006419228B1

(12) United States Patent
Egli et al.

(10) Patent No.: US 6,419,228 B1
(45) Date of Patent: Jul. 16, 2002

(54) MULTI-LEVEL, MULTI-DIFFICULTY, BOARD GAME WITH CIRCULAR SYMMETRY

(76) Inventors: Patrick Egli, 153 Chaparral Cir. SE., Calgary, Alberta (CA), T2X 3M2; Rick Derbyshire, 552 - 18 St. SW., Medicine Hat, Alberta (CA), T1A 8A7

( * ) Notice: Subject to any disclaimer, the term of this patent is extended or adjusted under 35 U.S.C. 154(b) by 0 days.

(21) Appl. No.: 09/639,466

(22) Filed: Aug. 15, 2000

(51) Int. Cl.[7] ..... A63F 3/00

(52) U.S. Cl. ..... 273/236; 273/241; 273/242; 273/249; 273/260; 273/261; 273/267; 273/285; 273/287; 273/409

(58) Field of Search ..... 273/236, 241, 273/260, 261, 285, 267, 249, 242, 409, 287, 157 R

(56) References Cited

U.S. PATENT DOCUMENTS

| | | | | | |
|---|---|---|---|---|---|
| 2,549,708 | A | * | 4/1951 | Post | 273/135 |
| D211,529 | S | * | 6/1968 | Donnellon | D34/5 |
| D212,102 | S | * | 8/1968 | Hawkins | D34/5 |
| 3,592,472 | A | * | 7/1971 | Kent | 273/135 R |
| 3,661,391 | A | * | 5/1972 | Henshaw | 273/131 A |
| D254,428 | S | * | 3/1980 | Lasowski et al. | D11/157 |
| 4,552,363 | A | * | 11/1985 | Rehkemper et al. | 273/241 |
| 5,112,056 | A | * | 5/1992 | Ching | 273/241 |
| D334,359 | S | * | 3/1993 | Welcher, Jr. et al. | D12/115 |
| 5,251,900 | A | | 10/1993 | Gallant | |
| 5,286,026 | A | * | 2/1994 | Schnapp | 273/155 |
| 5,377,990 | A | * | 1/1995 | Seeney-Sullivan | 273/236 |
| D357,160 | S | * | 4/1995 | Fritze | D6/610 |
| 5,556,099 | A | * | 9/1996 | Mardirosian | 273/241 |
| 5,558,331 | A | * | 9/1996 | Zlotsky | 273/156 |
| 5,601,289 | A | | 2/1997 | Hollister | |
| 5,660,388 | A | * | 8/1997 | Benn | 273/241 |
| 5,794,932 | A | * | 8/1998 | Gastone | 273/241 |
| 5,826,880 | A | * | 10/1998 | Cooper | 273/261 |
| D413,046 | S | * | 8/1999 | Fritze | D7/610 |
| 6,257,575 | B1 | * | 7/2001 | Ortega | 273/241 |
| 6,276,685 | B1 | * | 8/2001 | Sterling | 273/241 |
| 6,276,687 | B1 | * | 8/2001 | Lenhart | 273/267 |
| 6,279,907 | B1 | * | 8/2001 | Hullinger | 273/241 |

* cited by examiner

*Primary Examiner*—Benjamin H. Layno
*Assistant Examiner*—Delores Collins
(74) *Attorney, Agent, or Firm*—Gene Scott-Patent Law & Venture Group

(57) ABSTRACT

The present invention provides a board game adaptable to one, two or three levels of play wherein the game board may be set correspondingly to one, two or three physical levels. The board is preferably round and accommodates two, three or four players. Game pieces are placed on the board, during play, from a choice of spots on an outer ring of the game board and progress inwardly toward the center of the board. When a player is able to position his four different color game pieces at the center of the board on corresponding colored game piece spots, and then move the pieces to a home board, he or she is the winner.

14 Claims, 4 Drawing Sheets

MULTI-LEVEL, MULTI-DIFFICULTY, BOARD GAME WITH CIRCULAR SYMMETRY

BACKGROUND OF THE INVENTION

1. Field of the Invention

This invention relates generally to board games such as checkers, chess or Go, and more particularly to a multilevel circular game board of unique characteristic.

2. Description of Related Art

The following art defines the present state of this field:

Rehkemper et al., U.S. Pat. No. 4,552,363 describes a game in which the players construct a three dimensional playing field during the course of play using pieces that include assigned tokens and common tiles. Each of the tiles is divided into a number of spaces such that each space is adapted to support either an assigned token or a portion of another tile with latter establishing a new level. A board provides a base surface with markings for the placement of the first level of tiles. Each of the tiles is constructed such that its upper surface can support other tiles or tokens. The tokens are supported by recesses located on the upper surface of the tiles. Other tiles are supported by intersecting slots located on the upper surface of the tiles. The game is won by the first player to place an assigned token atop a pre-selected level.

Ching, U.S. Pat. No. 5,112,056 describes a multi-tier checkered game board having rows and columns. The multi-tier checkered game board includes a first tier which includes 8 rows and 8 columns of 64 equal sized squares. The 64 equal sized squares alternate in color from clear to tinted. A second tier having a center with a hole and is displaced a distance above the first tier, and includes 4 rows and 4 columns of 16 equal sized squares, the 16 equal sized squares alternates in the color from the clear to the tinted. A third tier having the center with the hole and is displaced the distance above the second tier, and includes 2 rows and 2 columns of 4 equal sized squares, the 4 equal sized squares alternate in the color from the clear to the tinted. A fourth tier displaced a distance above the third tier, and including 1 square, the square being the color of clear.

Gallant, U.S. Pat. No. 5,251,900 describes a puzzle formed of a plurality of puzzle pieces which, when assembled, create a self-standing, three-dimensional building structure. The puzzle pieces are of irregular, polygonal shape, but all puzzle pieces are flat, planar blocks. The blocks are releasably interlocked about a common plane with first, edgewise, complementary dovetail joints. For to interlocking puzzle walls that are transverse to one another, second, straight U-shape, edgewise, complementary tenon and mortise joints are further provided edgewisely of those comer blocks for frictional interlocking. Thus, no separate pin, bent units or the like are required to anchor the corner portions of the three dimensional structure. The self-standing, enclosing structure is continuous, and show a continuous image on its external face.

Mardirosian, U.S. Pat. No. 5,556,099 describes a three dimensional chess game having multiple tiers with role-static pieces and role-altering pieces, the latter pieces being able to assume more than one role during the present game. For example, the role-altering pieces can change roles when they move between the upper and lower tiers, or when they participate in captures, that is, capturing or being captured. Also, the roles of the role-altering pieces may include roles that are similar to and/or different from those of the role-static pieces. To emphasize the change in roles or capacities, the role-altering pieces can be physically altered to reflect or signify their different roles. For example, the Helicopters may have removable upper blade portions positionable on lower portions which resemble the Pawns. Also, for example, the Planes may have removable upper wing portions positionable on lower portions which resemble the Bishops.

Hollister, U.S. Pat. No. 5,601,289 describes a chess piece for a three-dimensional vertical stacking chess game which includes a body having a plurality of faces for abutting stacking engagement with a face of another chess piece. Indicia appears on each of the plurality of faces representing a single chess piece. Indicia further appears on each of the plurality of faces representing a vertical level of game play.

Benn, U.S. Pat. No. 5,660,388 describes a board game comprising a board and a set of movable pieces for each of two players. The board is marked into a matrix of spaces forming a plurality of concentric perimeters, the innermost perimeter surrounding a single central space. Each perimeter comprises a separate level, the outermost perimeter being the lowermost level, and the central space forming the uppermost level. Each level has selected "jumping" spaces. A player may move a piece may only to an adjacent space on the same level, except when (1) the piece is on a jumping space, or (2) another piece is on an adjacent space on the same level, or (3) another piece is on adjacent space on the next higher level. When a piece is on a jumping space, it may jump to the immediately adjacent space on the next higher level. When another piece is on an adjacent space on the same level, the piece to be moved may jump over that piece to the next space on the same level. When another piece is on an adjacent space on the next higher level, the moving piece may jump over that piece to the next space one level above it. If the jumped-over piece is that of the opposing player, it may be moved to any unoccupied space on the lowest level. When a piece reaches the central space, it is removed from play. The first player to remove all of his or her pieces from play wins.

Gastone, U.S. Pat. No. 5,794,932 describes a board game that features a plurality of game-boards and a support structure such as a central column joined with the game-boards. The plurality of game-boards include an upper transparent game-board, an intermediate transparent game-board and a base game-board. Each game-board has an upper playing field lying flush with one of three horizontal planes that are vertically spaced from one another. Each of the playing fields includes two sets of parallel lines with the sets arranged orthogonal to each other so as to define a plurality of intersecting paths which intersect at intersection points. A plurality of the paths extend diagonally off of external peripheral edges of the playing fields of corresponding game-boards, with each playing field being multi-sided such as an eight sided playing field. The board game also includes a first series of game pieces which includes a first, a second and a third game piece type. Also included is a second series of game pieces visually distinct from the first series of game pieces. The second series of game pieces includes a first, second and third game piece type that is similarly configured with the three different types in the first series.

The prior art teaches that board games may use boards having more than one plane, or level of play and that such physical levels my be advantageously employed to make the game rules and game progress more interesting. However, the prior art does not teach that such a game may employ a circular symmetry enabling radial game piece motion toward the center of the board to capture the center spaces in a winning series of moves. The present invention fulfills these needs and provides further related advantages as described in the following summary.

SUMMARY OF THE INVENTION

The present invention teaches certain benefits in construction and use which give rise to the objectives described below.

The present invention provides a board game adaptable to one, two or three levels of play wherein the game board may be set correspondingly to one, two or three physical levels. The board is preferably round and accommodates two, three or four players. Game pieces are placed on the board, during play, from a choice of spots on an outer ring of the game board and then progress inwardly toward the center of the board. When a player is able to position his four different color game pieces at the center of the board on corresponding colored game piece spots and then move them off to his/her separate home board, he/she is the winner.

A primary objective of the present invention is to provide a board game with multiple level of play difficulty, having advantages not taught by the prior art.

Another objective is to enable the game board to be set at selected physical levels corresponding to the difficulty levels of game play.

A further objective is to provide a board game adaptable to, from two to, four players.

A still further objective is to provide a board game of strategy, cunning, ease of play, and of enjoyment.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
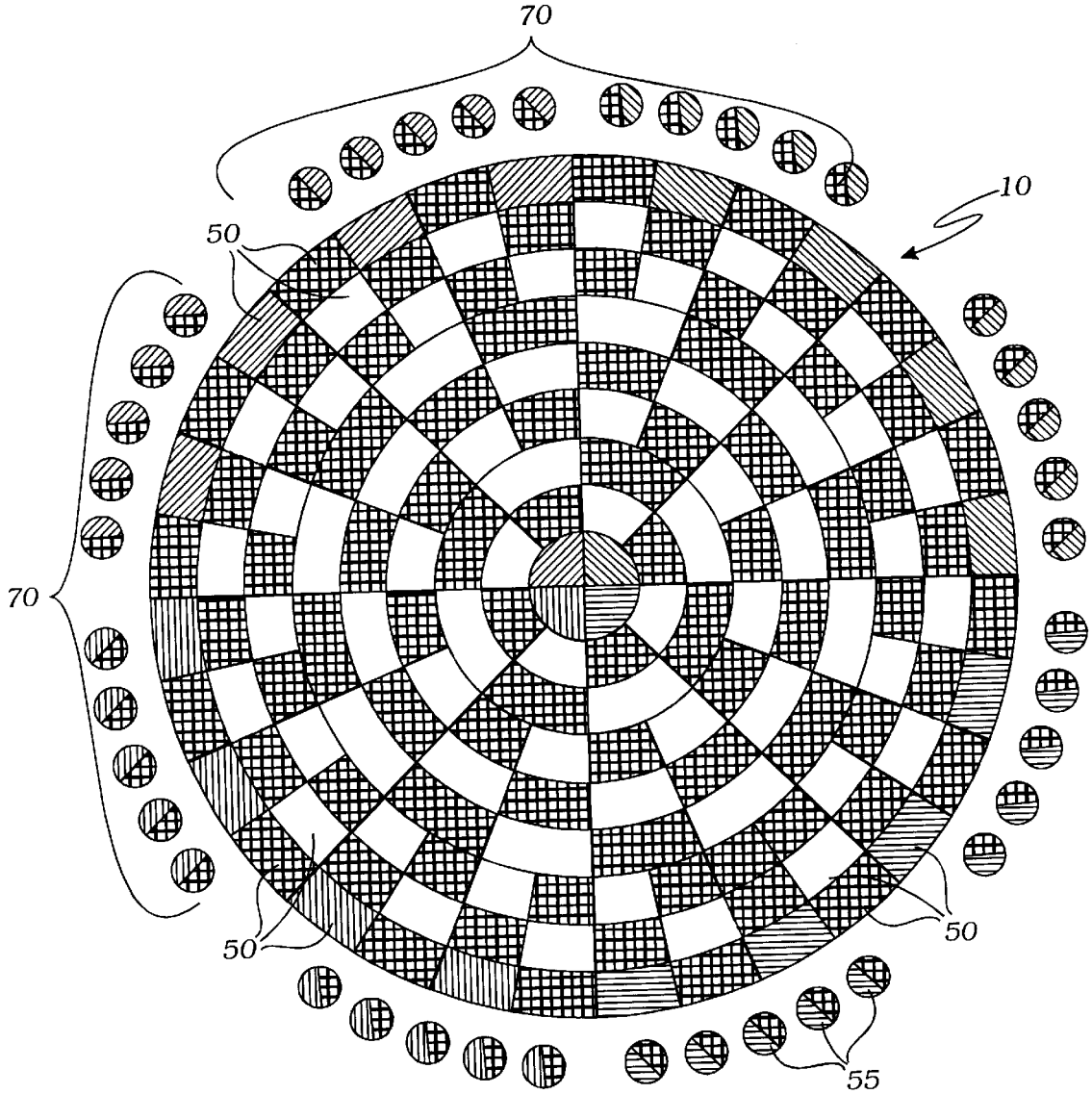
FIG. 1 is a top plan view of the preferred embodiment of the present invention a board game.

The above described drawing figures illustrate the invention, a board game apparatus comprising a circular game board 10 including a central circular board portion 20, a medial circular ring board portion 30, and an outer circular ring board portion 40, the three board portions 20, 30, and 40 being mutually separate and separable, but adapted by their size and shape for fitting together contiguously to form the circular game board 10. Each of the board portions 20, 30, and 40 provide a board surface indicia, preferably inked or printed markings, having three visually discriminated, radially consecutive, ring zones, an inner ring zone, a medial ring zone and an outer ring zone, and these zones are marked with the reference numeral of each of the board portions appended with (') for the inner ring zone, (") for the medial ring zone, and (''') for the outer ring zone. It should be noted that the inner ring zone 20' takes the form of a circular spot since it is at the center of the game board 10. For clarity the various rings are numbered within blank spaces on the board in FIGS. 2 and 3. Now, each of the ring zones in each of the board portions 20, 30, and 40 provides a series of visually discriminated circumferentially adjacent game piece spots 50 as is clearly shown in the figures as either the blank spaces referred to in the previous sentence or with different cross-hatch patterns.

A plurality of game pieces 55 are adapted, by having a flat base surface 57, for being rested on the game piece spots 50 of the circular game board 10, and further are adapted, by having a flat top surface 59 for enabling any one of the game pieces 55 to be tested atop any other of the game pieces 55. Necessarily, the game pieces 55 are comprised of sets 70, each of the sets 70 corresponding to one of at least two, and at most four players, the game pieces 55 of each of the sets 70 being visually distinguishable from each of the game pieces 55. of the other sets 70. Also, the game pieces 55 within each of the sets 70 are necessarily distinguishable by a selected game piece characteristic, such as color, shape or size from each other, the selected characteristic matching a similar board game piece spot characteristic, most preferably color.

A means for positioning the medial circular board portion 30 at an elevation above the other board portions 20 and 40, or with the medial circular board portion 30 at the same level as the central circular board portion 20, but with both positioned above the outer circular ring board portion 40, or with the central 20, medial 30 and outer board 40 portions at each of three distinct elevations (FIGS. 2 and 3), comprises a frame 60 upon which the board portions may be placed and preferably fixedly engaged. Such a frame 60 may be constructed in any manner whatsoever in accordance with the objective of a stable game apparatus, and this is within the means of those of skill in the art. The above described configuration where the medial board portion 30 is raised above the central 20 is not shown in the figures, but it is clear that such would be within the capability of those of skill in the art, since it comprises a minor modification to the other configurations shown.

Figure 2:
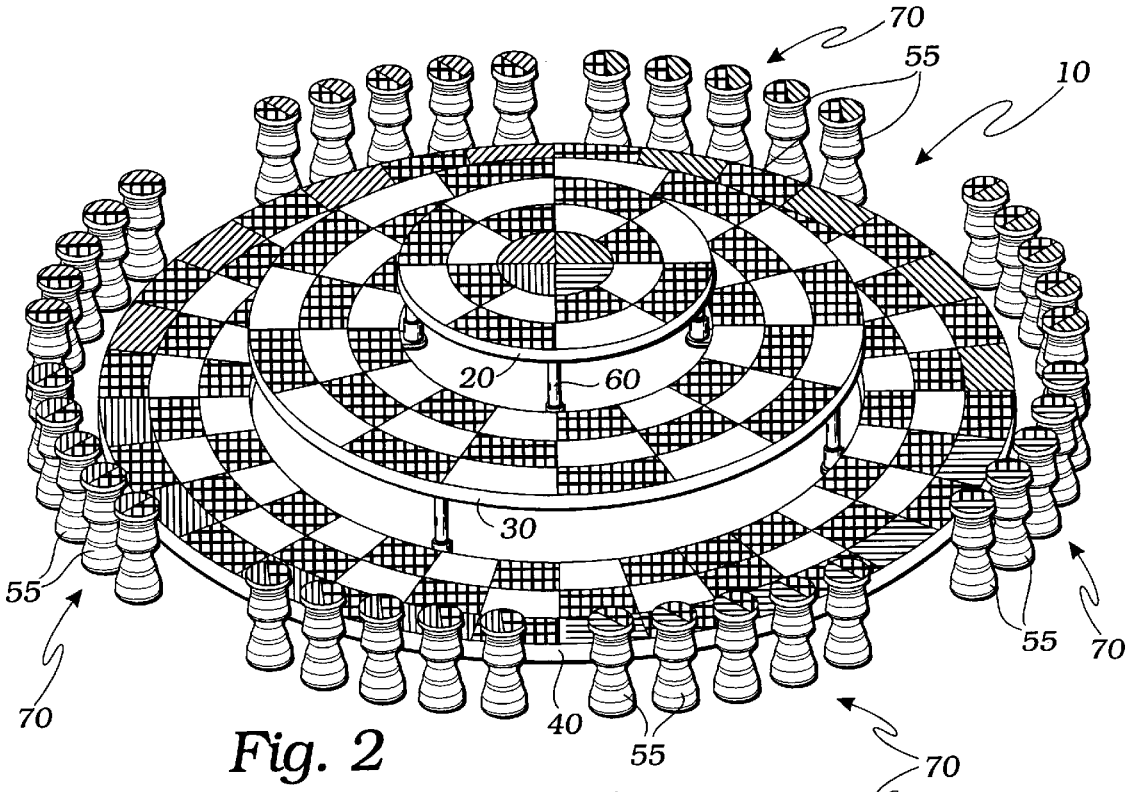
FIG. 2 is a perspective view thereof showing a preferred manner of raising portions of a game board of the board game.
Figure 3:
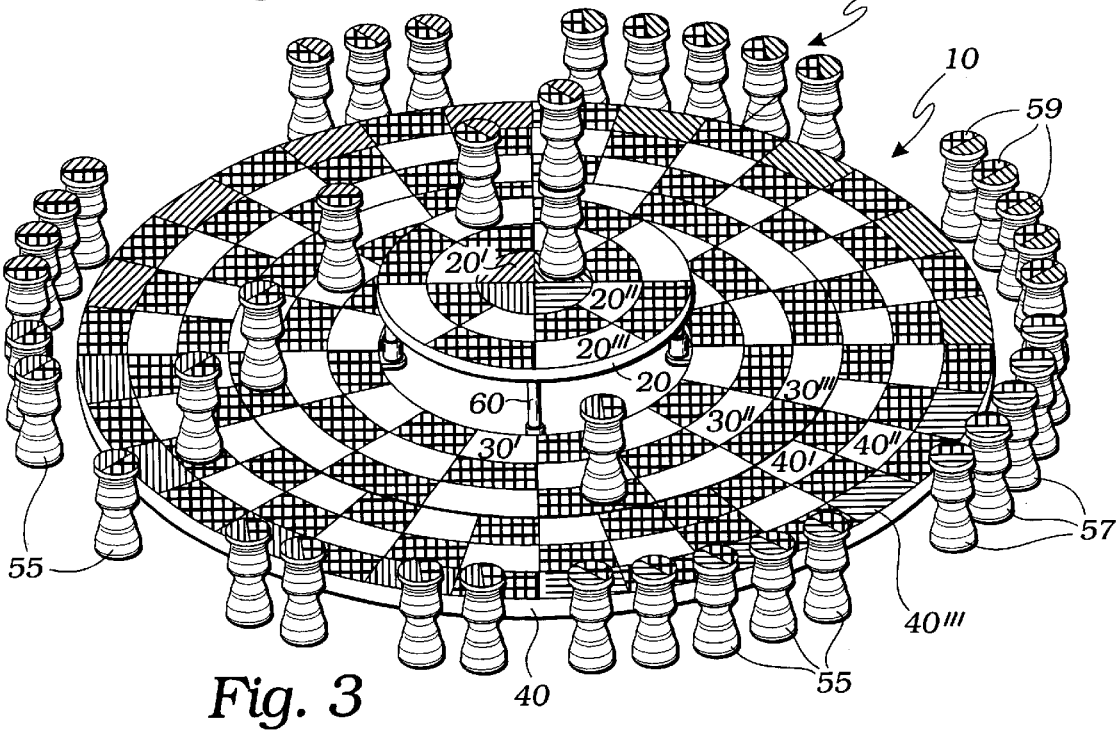
FIG. 3 is similar to FIG. 2 showing a manner of placement of game pieces onto the game board during play of the board game.

The board game method comprises the steps of providing the circular game board 10 described above, and then placing the game pieces 55, one per turn, onto the game board 10 at each sequential turn of each of a plurality of players, starting with placement of a game piece 55 on one of the game piece spots 50 of the outer ring zone 40''' of the outer circular ring board portion 40, and then moving the game pieces 55 from each zone to each adjacent zone as necessary and desired within the rules of play of the game. The method further provides the step of winning the game by placement of each of a plurality of visually distinct game pieces 55 of only one of the players onto the inner. ring zone 20' of the central circular board portion 20 and then onto the player's home base board or disk, shown in FIG. 6. In playing the game with a further level of difficulty, the further step of positioning the central circular board portion 20 at an elevation above the other board portions 30, 40 may be taken. Alternately, the further step of positioning the medial circular ring board portion 30 at an elevation equivalent to the central circular board portion 20 such that the central circular board portion 20 and the medial circular ring board portion 30 are at an equivalent height above the outer circular ring board portion 40 may be used. A still further alternative step of positioning the medial circular ring board portion 30 at an elevation below the central circular board portion 20 but above the outer circular ring portion 40 to produce three levels of play as shown in FIGS. 2 and 3 may be advantageously employed as described below.

To further understand the advantageous of the above described apparatus and method the following description is provided, but it should be understood that the following is only one of a large possible number of methods of play that may be employed in the present invention.

The preferred method of play is called "Universal Forces" and is a board game that requires players to achieve a common objective. The game involves the balancing of offensive and defensive scenarios in order to win the game. This balancing of power leads to many interesting and multifaceted strategic situations. Strategies are based upon controlling various areas and levels of the playing area as well as controlling opponents' forces. This makes each game unique and provides a multitude of variety and challenges. As novices become better with the game at its simplest configuration, the game can then be advanced to a higher plateau or level in order to provide more challenges and difficulties. This game can be played with two, three or four players. The playing area, or game board 10 is a three-part multi-level board as described above. The outer circular ring portion 40, or Board 1, is the largest ring board and has 16 colored sections on the outermost circumference. These colored sections are in four groups; red (4), green (4), yellow (4) and blue (4). The medial circular ring portion 30, or Board 2, is the smaller ring board and has no color sections. The center circular board portion, or Board 3 is the small center board, which has 4 color sections in the center, which correspond to the four force colors. There are also four home base disks 80, one for each of the players, and these correspond to the four colored center sections of Board 3.

Figure 4:
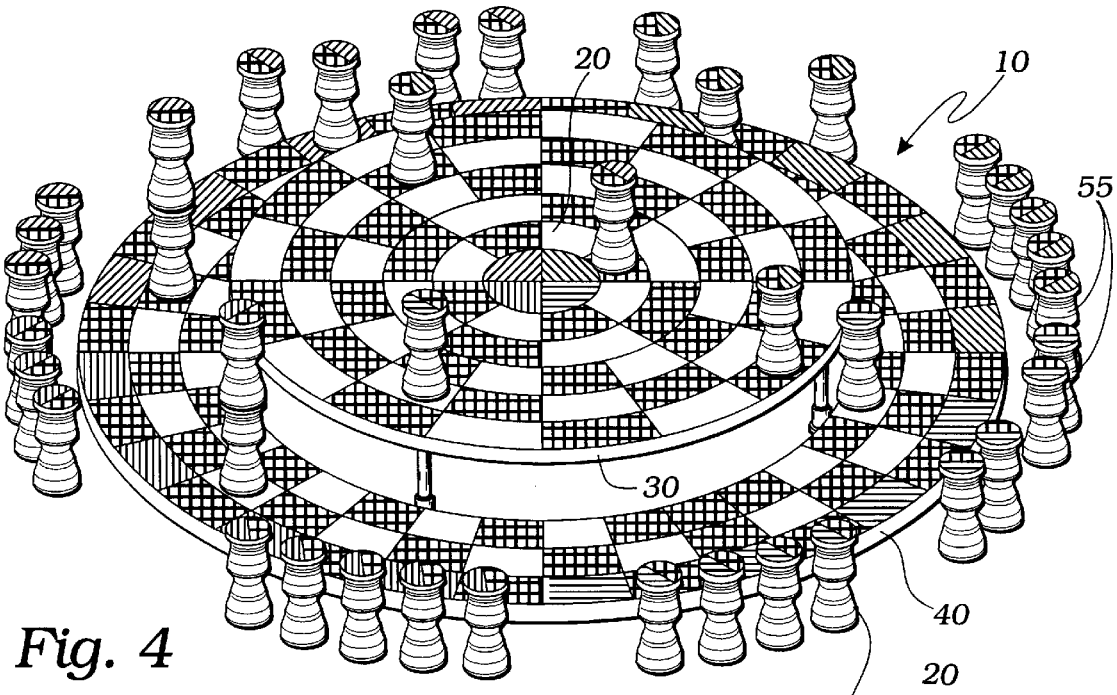
FIG. 4 is similar to FIG. 2 showing an alternate manner of raising portions of the game board.
Figure 5:
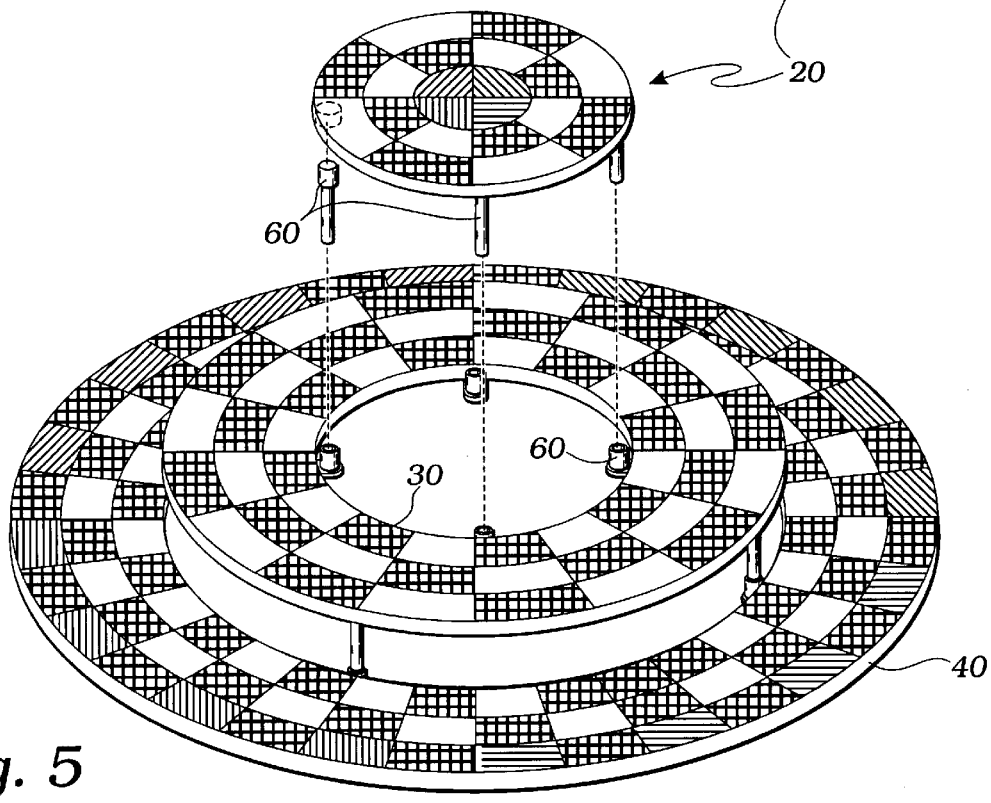
FIG. 5 is similar to FIG. 2 showing further details of the construction of the game board.
Figure 6:
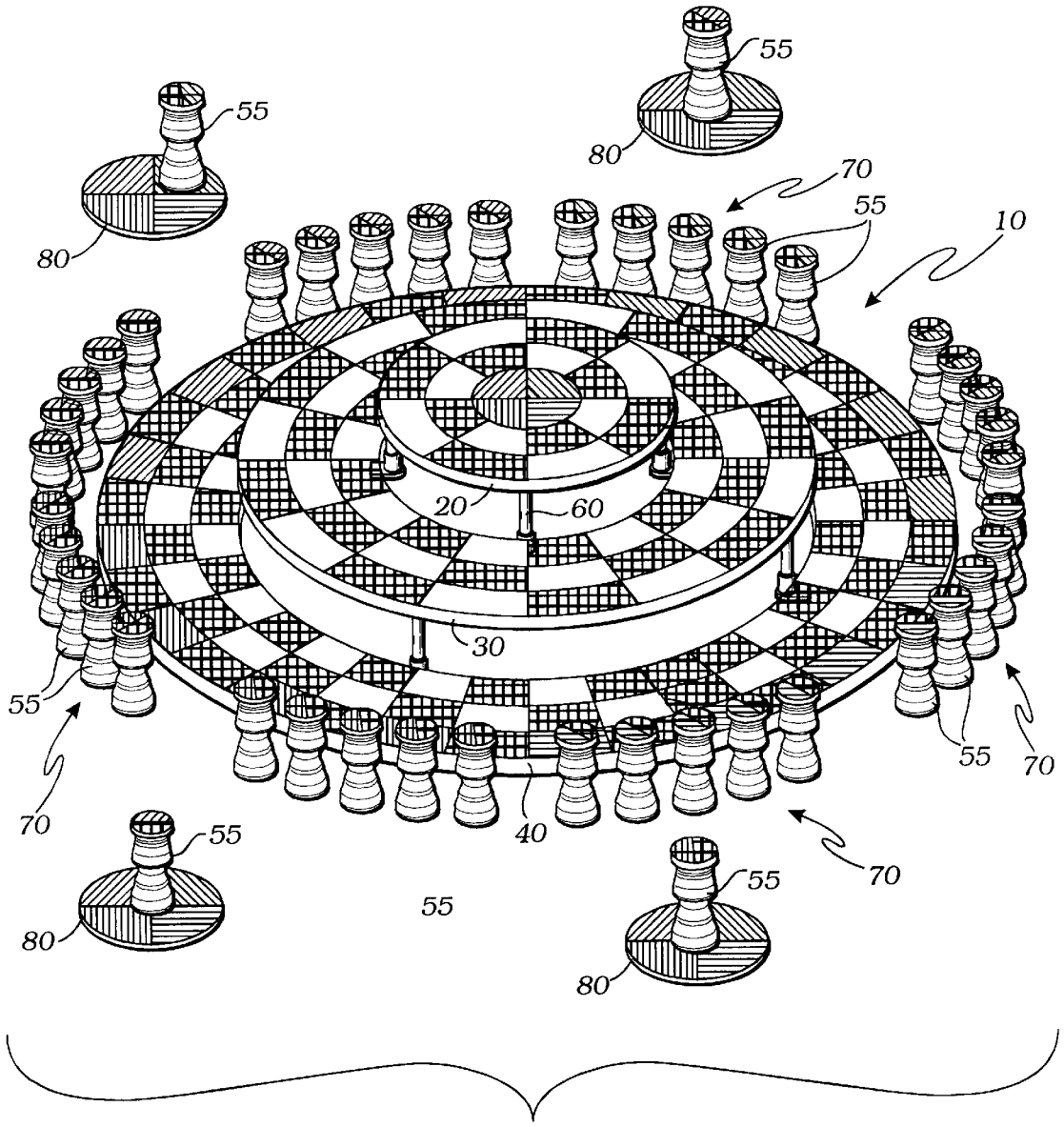
FIG. 6 is similar to FIG. 2 showing further details of the construction of the game board and a set of four separate home game boards.

Possible board configurations for play are:

1. Board 1 down, board 2 down and board 3 down, as shown in FIG. 1. (1 level of play) Novice level (Also home base disks are preferably used at this level).
2. Board 1 down, board 2 down and board 3 raised. (2 levels of play) Intermediate level (Also home base disks are preferably used at this level).
3. Board 1 down, board 2 and board 3 raised together, as shown in FIG. 4. (2 levels of play) Intermediate level (Also home base disks are preferably used at this level).
4. Board 1 down, board 2 raised and board 3 raised, as shown in FIGS. 2, 5 and 6. (3 levels of play) Master level.

Once a board configuration has been chosen, at the beginning of the game, it cannot be changed during the course of that game.

Each player has a number of playing pieces 55 called forces and identified by a unique individualized shape representing the player. The forces are divided into four groupings and identified by color as follows; the number of each type of force for each player is not limited to three. Rather 4, 5, 6, etc. of each type of force is possible as long as each player has the same quantity.

The strengths of each force are as follows:

Mountain is stronger than wind and water, but weaker than fire.

Wind is stronger than water and fire, but weaker than mountain.

Water is stronger than fire, but weaker than mountain or wind.

Fire is stronger than mountain, but weaker than wind or water.

The strengths of each force are circular in nature and therefore no single force is strongest or weakest.

The objective of the game is to be the first player to place one of each type of their forces in the corresponding color sections in the middle of board 3, and in an additional move, removing the force from the game board to the safety of the player's home base disk.

Winning the game will occur when the first player achieves the objective, or if the objective cannot be met by any player, then the player with the greatest number of distinct forces on his/her home base disk wins. If one player can pin all of their opponents forces in such a-manner that none of the opponents can complete any further moves, then that player wins. However, a draw occurs if none of the players is able to put any forces through to their respective colored sections on their home base disk during the course of the game, or if during the course of the game, all players decide to mutually resign from further play, even though further play is possible.

To start the game, one player is chosen to go first. Once the first player has completed their turn, then the other players take their turns, one at a time, in a clockwise direction around the playing area, moving only one force at a time. Every force of all players must enter the playing area on its respective unoccupied colored section on board 1. If all of the colored sections on board 1 are occupied, the player cannot place a new force on the board at that time and must move another force, which is already in play on the board, if possible.

A move occurs when a player enters a force on the playing area on an unoccupied spot 50 of the same color as the force. After that a force can move to any unoccupied adjoining section that touches the section (including on the comers) that it is resting on. Players move one force at a time and only one section at a time. A force cannot be moved off the playing area once it has entered the playing area. A force cannot be placed on or move to a colored section on board 1 that is not the same color as the force. Also, a move occurs when a player moves a force on its respective colored section on Board 3 to the same colored section on their home base disk.

If all the forces of a player cannot make a move, i.e., all forces are pinned and/or forces cannot enter the playing area on board 1, and provided that not all the other players are in a similar situation, then that player's turn is skipped.

Stacking is a defensive maneuver that a player uses to protect a force. A force that is on an adjoining section and on the same level on which the same player has an occupied section, can be placed on top of that adjoining section's force. The result is two of the player's forces resting on the same section (spot 50). The maximum number of forces on one section is two. Stacked forces cannot be moved together. The force on top must first be moved off as one turn, before the bottom force can be moved. Stacking is not permitted on any of the colored sections on board 1 or on any of the sections on Board 3. Both forces in a player's stacked force can be taken in a single move by an opponent's stronger force.

A force that is on an adjoining section and on the same level on which an opponent's same strength force is resting, can be placed on top of that opponent's force. This is called a pin, as the opponent's force, on the bottom, cannot be moved until the upper pinning force has been moved off, or taken. Pinning is not permitted on any of the colored sections on board 1 or on any of the sections on board 3.

A moving force can take an opponent's force on an adjoining section and on the same level as long as the opponent's force is not on a colored section on board 1. The moving force may take if it is stronger than the opponent's force. The opponent's weaker force is removed from that section and. the player's stronger force is placed on that section. The removed opponent's force cannot be used again in the course of a current game. If the moving force can take the top force of an opponent's two force stack, but not the bottom force, then the moving force and the opponent's top force of the stack are both removed from the playing area. This is known as a sacrifice.

If the opponent is pinning the player's force on that section and is weaker than the player's force on the adjoining section on the same level, then the player removes the opponent's force on the top and places their "taking" force on top of the pinned force. The result is a pinned force being, converted to a stack. If a player is pinning an opponent's force and has a stronger force in an adjoining section, then the player must remove the pinning force as one move, before being in position to take the opponent's weaker force on the next turn.

The player's force cannot take a pinned force directly, i.e., the opponent's force is the bottom force being pinned by a another player's force. The player must remove the pin as one move and then will be in a position to take the opponent's weaker force on the next turn. If an opponent is pinning a second opponent, then the player can take both forces in the pin with their stronger adjoining force.

In multi-level play, forces can only move to the next upper level if the player's force is the top force on either a stack or a pin and if the player's force is on the inner ring of board 1 or board 2. The adjoining section on the higher level board must either be unoccupied, have a weaker opponent's force on it, or a player's single force on it. Moving to the adjoining section in the latter two scenarios results in the opponent's force being taken, and a stack.

Forces can only move to next lower level if the player's force is on the outer ring of board 1 or board 2. The adjoining section on the lower board may not have a stronger force on it, a pinned force with the opponent's force on top, or a single force of the same player on it. When the player moves the force to the new section, the player takes the opponent's weaker force, the player pins the opponent's force, the player takes the opponent's weaker force and completes a stack, or the player completes a stack on the lower level.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A board game apparatus comprising:

a circular board including a central circular board portion, a medial circular ring board portion, and an outer circular ring board portion, the three board portions being mutually separate and adapted for fitting together to form a contiguous circular game board;

each of the board portions providing a board surface indicia having three visually discriminated, radially consecutive, ring zones, an outer ring zone, a medial ring zone and an inner ring zone, the inner ring zone of the central circular board portion taking the form of a circular spot;

each of the ring zones providing a series of visually discriminated circumferentially adjacent game piece spots; and a plurality of game pieces adapted for being rested onto the game piece spots of the circular board, and further adapted for enabling any one of the game pieces to be rested atop any other of the game pieces.

2. The apparatus of claim 1 further providing means for positioning the central circular board portion at an elevation above the other board portions.

3. The apparatus of claim 2 further providing means for positioning the medial circular ring board portion at an elevation equivalent to the central circular board portion such that the central circular board portion and the medial circular ring board portion are at an equivalent height.

4. The apparatus of claim 2 further providing means for positioning the medial circular board portion at an elevation below the central circular board portion but above the outer circular ring portion.

5. The apparatus of claim 1 wherein the game pieces are comprised of sets, each of the sets corresponding to one of at least two players, the pieces of each of the sets being visually distinguishable from each of the other of the sets.

6. The apparatus of claim 5 wherein the game pieces within each of the sets are distinguishable by a selected game piece characteristic, the selected characteristic matching a similar board game piece spot characteristic.

7. The apparatus of claim 1 further comprising a plurality of home boards; one of said home boards for each player, the home boards each having a plurality of visually distinct portions thereon.

8. A board game method comprising the steps of:

a) providing a circular game board including a central circular board portion, a medial circular ring board portion, and an outer circular ring board portion, the three board portions being mutually separate and adapted for fitting together to form a contiguous circular game board, each of the board portions providing a board surface indicia having three visually discriminated, radially consecutive, ring zones, an outer ring zone, a medial ring zone and an inner ring zone, the inner ring zone of the central circular board portion taking the form of a circular spot, each of the ring zones providing a series of visually discriminated circumferentially adjacent game piece spots, and a plurality of game pieces adapted for being rested onto the game piece spots of the circular board, and further adapted for enabling any one of the game pieces to be rested atop any other of the game pieces;

b) placing game pieces onto the game board at each sequential turn of each of a plurality of players, starting with placement of a game piece on one of the game piece spots of the outer ring zone of the outer circular ring board portion;

c) moving the game pieces from each zone to an adjacent zone as necessary and desired within the rules of play of the game;

d) winning the game by placement of each of a plurality of visually distinct game pieces of one of the players on the inner ring zone of the central circular board portion.

9. The method of claim 8 further providing the step of positioning the central circular board portion at an elevation above the other board portions.

10. The method of claim 9 further providing the step of positioning the medial circular ring board portion at an elevation equivalent to the central circular board portion such that the central circular board portion and the medial circular ring board portion are at an equivalent height.

11. The method of claim 9 further providing the step of positioning the medial circular board portion at an elevation below the central circular board portion but above the outer circular ring portion.

12. The method of claim 8 further providing the step of forming the game pieces into distinguishable sets, each of the sets corresponding to one of at least two players.

13. The method of claim 12 further providing the step of forming the game pieces, within each of the sets, so as to be distinguishable by a selected game piece characteristic, the selected characteristic matching a similar board game piece spot characteristic.

14. The method of claim 8 wherein step (d) further comprises moving at least one of the game pieces from the central circular board portion to at least one of a separate and distinct home board.

* * * * *